US006067057A

United States Patent [19]

Yajima et al.

[11] Patent Number: 6,067,057

[45] Date of Patent: May 23, 2000

[54] ATTACHING MECHANISM FOR GPS ANTENNA

[75] Inventors: Hideo Yajima; Toshikazu Ogino; Akio Takizawa, all of Kanagawa, Japan

[73] Assignee: Mitsumi Electric Co., Ltd., Tokyo, Japan

[21] Appl. No.: 09/138,558

[22] Filed: Aug. 24, 1998

[30] Foreign Application Priority Data

Aug. 29, 1997 [JP] Japan ..... 9-249991

[51] Int. Cl.[7] ..... H01Q 1/12

[52] U.S. Cl. ..... 343/878; 343/880; 343/713

[58] Field of Search ..... 343/702, 713, 343/878, 880; 361/686; 248/185.1; H01Q 1/12

[56] References Cited

U.S. PATENT DOCUMENTS 5,619,395 4/1997 McBride ..... 361/683

5,912,648 6/1999 Walther ..... 343/713

FOREIGN PATENT DOCUMENTS 108159139 6/1996 Japan ..... H01Q 1/12

*Primary Examiner*—Don Wong

*Assistant Examiner*—Shih-chao Chen

*Attorney, Agent, or Firm*—Whitham, Curtis & Whitham

[57] ABSTRACT

An attaching mechanism for a GPS antenna is disclosed. The attaching mechanism comprises a clip for gripping a plate-shaped member and having a shaft supporting member, a shaft in which one end thereof is supported by the shaft supporting member, and a base member fixed to the other end of the shaft and on which a GPS antenna is mounted.

8 Claims, 4 Drawing Sheets

ATTACHING MECHANISM FOR GPS ANTENNA

BACKGROUND OF THE INVENTION

1. Technical Field of the Invention

The present invention relates to an attaching mechanism for a GPS (global positioning system) antenna which is used for attaching the GPS antenna to a portable personal computer.

2. Description of the Related Art

The GPS system having been spread as a positioning system requires a GPS antenna for receiving radio wave transmitted from satellites. High-grade calculation function is required in order to accurately calculate the current position on the basis of the signals received by the GPS antenna. If such a calculation can be performed by a personal computer, in particular, a portable personal computer such as a note book personal computer, the field to which the GPS system can be applied will be spread rapidly.

In general, the GPS antenna is disposed with reference to the horizontal plane so as to optimize the receiving sensitivity thereof. The GPS antenna to be mounted on a vehicle is disposed most suitably at the time of mounting it on the vehicle since the horizontal plane is defined by the vehicle body. In contrast, the portable GPS antenna is always required to adjust its position with respect to the horizontal plane.

In a system where the signal received by a GPS antenna is subjected to calculation processing by a portable personal computer, there arises a problem as to where the GPS antenna is to be disposed. That is, since an operator operates a key board disposed on the front side of a display panel in a state that the display panel is opened, there is no place where the GPS antenna is to be disposed. This is a problem to be obviated by the present invention.

SUMMARY OF THE INVENTION

It is therefore an object of the present invention is to provide an attaching mechanism for a GPS antenna which can be detachably attached to the display panel of a personal computer and easily define the horizontal plane thereof.

In order to achieve the aforesaid object, there is provided an attaching mechanism for a GPS antenna which comprises: a clip for gripping a plate-shaped member and having a shaft supporting member; a shaft in which one end thereof is supported by the shaft supporting member; and a base member fixed to the other end of the shaft and on which a GPS antenna is mounted.

DETAILED DESCRIPTION OF THE PREFERRED EMBODIMENTS

Preferred embodiments of the present invention will be described below in detail with reference to the accompanying drawings.

Figure 1:
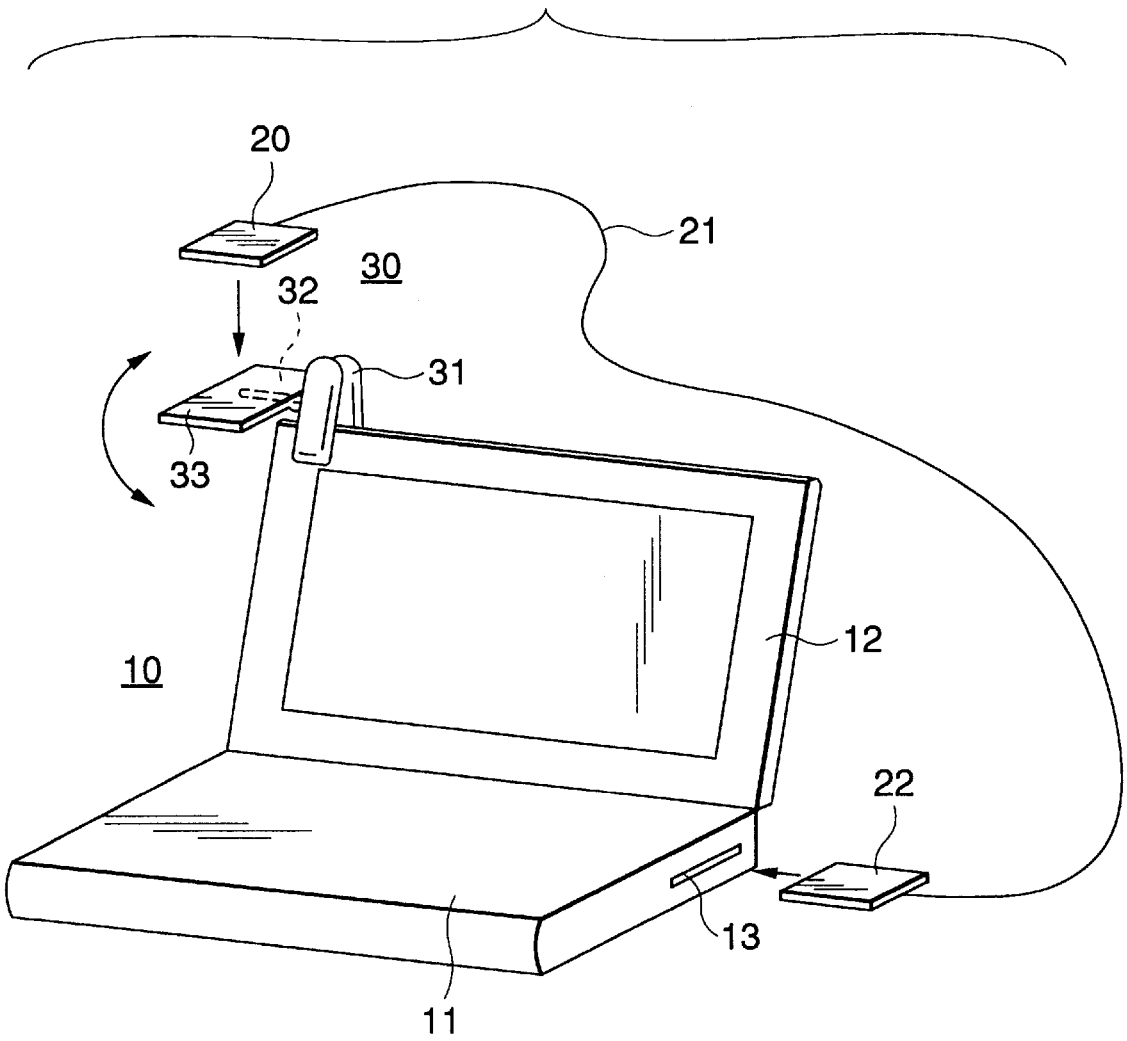
FIG. 1 is a perspective view of an attaching mechanism for a GPS antenna according to the first embodiment of the present invention.

FIG. 1 is a perspective view of the entire arrangement of an attaching mechanism for a GPS antenna according to the first embodiment of the present invention. In the figure, a reference numeral 10 denotes a portable personal computer, 11 is a key board, 12 is a display panel in an opened state, 13 is a slot for inserting a PCMCIA (Personal Card Memory International Association) card therein, 20 is the GPS antenna, 21 is an antenna cable, 22 is the PCMCIA card having a received signal processing circuit effecting demodulation or the like of the received signal. The cable 21 is disposed between the antenna 20 and the card 22 so as to connect therebetween, and the card 22 is inserted into the slot 13 upon usage of the GPS antenna 20.

A reference numeral 30 denotes the attaching mechanism for the GPS antenna according to the first embodiment of the present invention, 31 is a clip for gripping or holding the upper end of the display panel 12 of the personal computer 10, 32 is a shaft whose one end is supported by the clip 31, 33 is a planer base plate fixed at the other end side of the shaft 32. In use, the base plate 33 is rotated around the shaft 32 and adjusted so as to be level. The GPS antenna is disposed on the base plate 33.

In this manner, since the attaching mechanism is arranged in a manner that the base plate 33 can rotate around the shaft 32, the base plate 33 can be kept to be level in accordance with the open angle of the display panel 12 of the personal computer 10.

Figure 2:
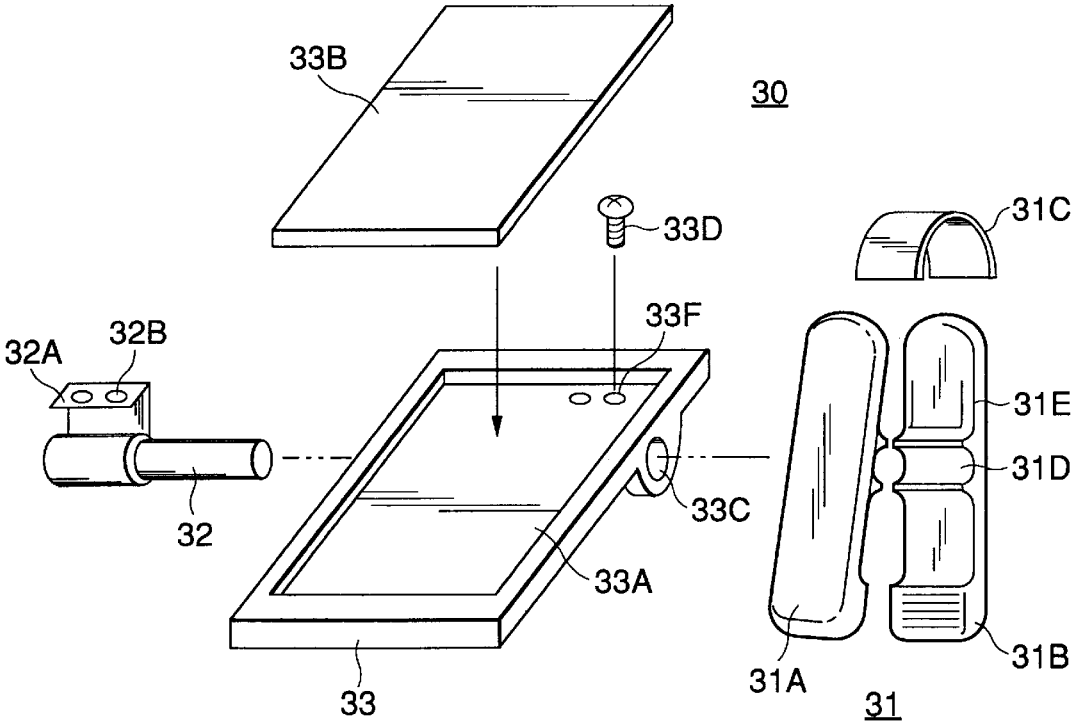
FIG. 2 is an exploded perspective view of the attaching mechanism for a GPS antenna of FIG. 1.
Figure 3:
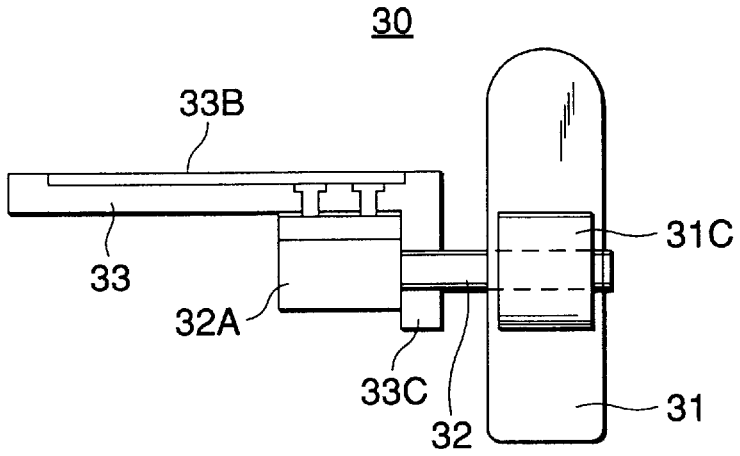
FIG. 3 is a sectional view showing the assembled state of the attaching mechanism for a GPS antenna of FIG. 1.

FIG. 2 is an exploded perspective view of the attaching mechanism 30 for a GPS antenna according to the first embodiment of the present invention. FIG. 3 is a sectional view showing the assembled state of the attaching mechanism. As shown in the figures, the clip 31 is formed by a pair of supporting members 31A, 31B and a U-shaped spring 31C. At the center portion of each of the pair of the supporting members 31A, 31B, a convex portion 31E is formed so as to provide a semicircular recess portion 31D serving as the center of the rotation therebetween. The spring 31C is disposed between the pair of supporting members 31A, 31B as shown in FIG. 4.

A rectangular recess 33A is formed on the base plate 33 and a steel plate 33B is provided thereon. This metal plate 33B is used so as to attract a magnet for antenna attachment provided at the bottom portion of the GPS antenna 20. A bearing portion 33C is formed at the lower portion of the base plate 33 so that the shaft 32 passes therethrough. A stud 32A is formed integrally with the shaft 32. Screws 33D are screwed from the base plate 33 side into screw holes 32B formed in the stud 32A thereby to integrate the stud with the base plate 33. A reference numeral 33F denotes through holes for passing the screws 33D therethrough.

The shaft 32 thus integrated with the base plate 33 is inserted into the pair of the semicircular-shaped recess portions 31D of the clip 31 so that the rotation position of the shaft relative to the clip 31 can be adjusted manually in accordance with the rotation torque utilizing the elasticity of the spring 31C and the friction of the material. Such a rotation torque serves as the gripping force for keeping the leveling of the base plate 33 even when the GPS antenna 20 is placed thereon. However, the base plate 33 can be rotated and its angle can be adjusted by manually applying force of some extent thereto.

Figure 4A:
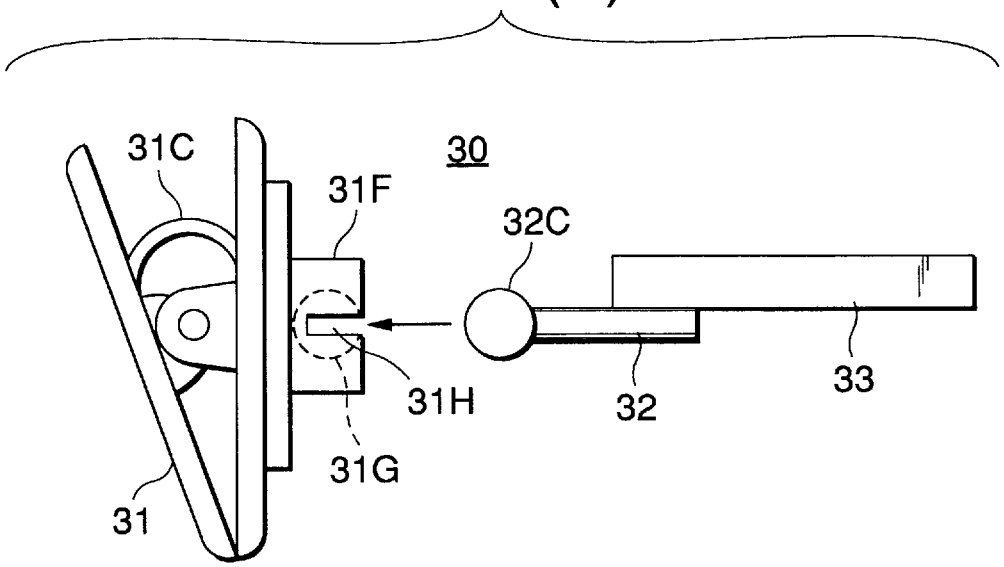
FIGS. 4(A) and 4(B) are diagrams showing the arrangement of an attaching mechanism for a GPS antenna according to the second embodiment of the present invention.
Figure 4B:
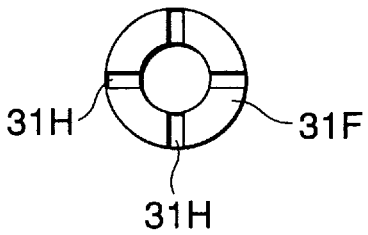

FIGS. 4(A) and 4(B) are diagrams showing the arrangement of the attaching mechanism for a GPS antenna according to the second embodiment of the present invention. The attaching mechanism 30 for a GPS antenna according to this embodiment is arranged in a manner that a shaft supporting portion 31F is integrated with a clip 31 and a base plate 33 is integrated with a shaft 32 in advance. A spherical member 32C is integrally provided at the tip portion of the shaft 32. The spherical member is pressed into the shaft supporting portion 31F. The shaft supporting portion 31F includes a spherical recess portion 31G and a plurality of notched portions 31H into which the spherical member 32C provided at the tip portion of the shaft 32 is pressed and held therein. Accordingly, also in this embodiment, the base plate 33 can be rotated around the shaft 32 and its angle can be adjusted.

According to this type of the attaching mechanism, since the shaft 32 protrudes to the direction perpendicular to the recess portion 31G of the clip 31, the clip 31 can be attached to an arbitrary position of the upper end portion of the display panel 12 of the personal computer 10.

Figure 5:
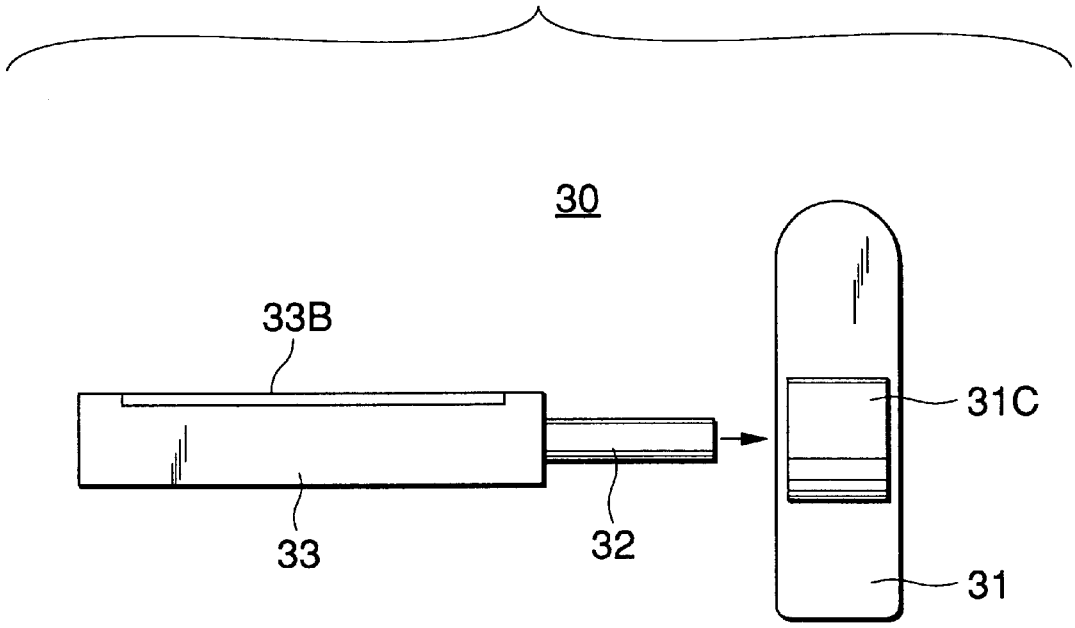
FIG. 5 is a diagram showing the arrangement of an attaching mechanism for a GPS antenna according to the third embodiment of the present invention.

FIG. 5 is a side view showing the arrangement of the attaching mechanism for a GPS antenna according to the third embodiment of the present invention. The attaching mechanism for a GPS antenna according to this embodiment is such a type that a base plate 33 and a shaft 32 are integrally formed by resin material and the shaft 32 is inserted into the aforesaid circular recess portion of the clip 31. This type of the attaching mechanism is advantageous in a point that the number of constituent parts is minimum among the aforesaid embodiments.

As described above, according to the present invention, it is possible to provide such an attaching mechanism for a GPS antenna which can be detachably attached to the display panel of a personal computer and define the horizontal plane thereof easily.

What is claimed is:

1. An attaching mechanism for a GPS antenna comprising:

a clip for gripping a plate-shaped member and having a shaft supporting member;

a shaft in which one end thereof is supported by the shaft supporting member, wherein the shaft may be positioned substantially horizontally when the clip is gripping the plate-shaped member; and a base member fixed to the other end of the shaft and on which the GPS antenna is mounted, to adjust a receiving angle of the GPS antenna independently from a tilt angle of the plate-shaped member.

2. The attachment mechanism for a GPS antenna as set forth in claim 1, wherein the base member is integrally formed with the other end of the shaft.

3. The attachment mechanism for a GPS antenna as set forth in claim 2, wherein the shaft extends in a direction perpendicular to the gripping direction of the clip.

4. The attachment mechanism for a GPS antenna as set forth in claim 2, wherein the shaft extends in a direction identical with the gripping direction of the clip.

5. An attaching mechanism for attaching a GPS antenna to a portable personal computer comprising:

a clip, having a shaft supporting member, for gripping a display panel of the portable personal computer when in an open position;

a shaft in which one end thereof is supported by the shaft supporting member, wherein the shaft may be positioned substantially horizontally when the clip is gripping the display panel of the portable personal computer; and a base member fixed to the other end of the shaft and on which a GPS antenna is mounted, to adjust a receiving angle of the GPS antenna independently from a tilt angle of the display panel of the portable personal computer.

6. The attachment mechanism for a GPS antenna as set forth in claim 5, wherein the base member is integrally formed with the other end of the shaft.

7. The attachment mechanism for a GPS antenna as set forth in claim 6, wherein the shaft extends in a direction perpendicular to the gripping direction of the clip.

8. The attachment mechanism for a GPS antenna as set forth in claim 6, wherein the shaft extends in a direction identical with the gripping direction of the clip.

* * * * *